US006073282A

United States Patent [19]

Leeper et al.

[11] Patent Number: 6,073,282

[45] Date of Patent: Jun. 13, 2000

[54] ADJUSTABLE LENGTH SLEEPING BAG

[75] Inventors: Sharon K. Leeper, Hermann; Rebecca S. Aulgur, Slater; Sheryl D. Schaefer, Fayette, all of Mo.

[73] Assignee: American Recreation Products, Inc., New Haven, Mich.

[21] Appl. No.: 09/245,490

[22] Filed: Feb. 5, 1999

[51] Int. Cl.[7] ..... A47G 9/08

[52] U.S. Cl. ..... 5/413 R; 2/69.5

[58] Field of Search ..... 5/413 R, 413 AM; 2/69.5

[56] References Cited

U.S. PATENT DOCUMENTS

| | | | |
|---|---|---|---|
| 1,370,009 | 3/1921 | Ehrenberg | 2/69.5 X |
| 2,150,486 | 3/1939 | Bjornson . | |
| 2,227,751 | 1/1941 | Idelman | 2/69.5 |
| 2,372,110 | 3/1945 | Noone | 5/413 R X |
| 2,657,387 | 11/1953 | Ketcham | 2/69.5 |
| 2,659,086 | 11/1953 | McGrath | 2/69.5 X |
| 2,670,470 | 3/1954 | Manheim et al. | 2/69.5 X |
| 2,675,552 | 4/1954 | Jackson . | |
| 2,680,849 | 6/1954 | Munro | 2/69.5 |
| 2,738,512 | 3/1956 | Winer | 2/69.5 X |
| 2,832,967 | 5/1958 | Sobel . | |
| 2,999,244 | 9/1961 | Wright . | |
| 3,034,132 | 5/1962 | Landsberger et al. | 2/69.5 |
| 3,304,556 | 2/1967 | Meyers et al. | 2/69.5 |
| 3,965,487 | 6/1976 | Mazur | 2/69.5 |
| 4,197,601 | 4/1980 | Maguire . | |
| 4,688,282 | 8/1987 | Jeffries . | |
| 4,884,303 | 12/1989 | Scherer | 5/413 R |
| 4,888,828 | 12/1989 | Tatsuno | 5/413 R |
| 4,989,282 | 2/1991 | Goldstein . | |
| 5,226,193 | 7/1993 | Chen | 2/69.5 |
| 5,473,779 | 12/1995 | Kramer . | |
| 5,560,043 | 10/1996 | Armstrong . | |
| 5,815,833 | 10/1998 | Kuo . | |

OTHER PUBLICATIONS

"Self–Adhering Nylon Tapes", *Journal of AMA*, vol. 168, No. 7. Gershman, Maurice, Oct. 1958.

*Primary Examiner*—Terry Lee Melius
*Assistant Examiner*—Robert G. Santos
*Attorney, Agent, or Firm*—Senniger, Powers, Leavitt & Roedel

[57] ABSTRACT

An adjustable length sleeping bag suitable for use by persons of different height. The bag includes an elongate insulated shell having a longitudinal axis, an outer surface, a foot end and a head end. A fastening system on the outer surface of the shell comprises one or more first fastener elements disposed around the shell generally transverse with respect to the longitudinal axis, and one or more second fastener elements disposed around the shell generally transverse with respect to the longitudinal axis at a location spaced longitudinally from said one or more first fastener elements. The first fastener elements are selectively engageable with the second fastener elements to reduce the length of the shell to accommodate a person of lesser height, and are selectively disengageable to increase the length of the shell to accommodate a person of greater height.

13 Claims, 3 Drawing Sheets

ADJUSTABLE LENGTH SLEEPING BAG

BACKGROUND OF THE INVENTION

This invention relates generally to sleeping bags, and more specifically to a sleeping bag that is adjustable in length to accommodate users of different height.

A sleeping bag is a durable overnight covering that provides generally soft padding, heat insulation, and weather-resistance. Sleeping bags are extensively used by backpackers, campers, and many others for portable and inexpensive bedding. Families, scouting troops, tour groups, and individuals use sleeping bags during recreational pursuits or whenever they need temporary bedding.

Ideally, a sleeping bag should be of a length that approximately fits the person using the bag. A property sized bag provides adequate cover and efficient heat insulation. If the bag is too short, an upper portion of the user, possibly including portions of the shoulders, arms, and chest, will not be covered. If the bag is is too long, it may not provide the user with efficient heat insulation around the feet. Specifically, the foot end of the bag will extend beyond the user's feet. As a result, this portion of the bag receives little or no heat from bodily warmth and becomes colder relative to the remainder of the bag. Even a portion of the bag adjacent the user's feet becomes colder since heat energy is lost to the extending foot end portion of the bag. Another drawback inherent to over-long sleeping bags is that the user, particularly a child, may move or shift position while sleeping during the course of a night and slide down further than intended into the interior of the bag. In that situation, the user's head may be inside the bag in a region of low air circulation and decreased oxygen availability.

Aggravating the problem is that sleeping bags are typically fixed in length. Children who have sleeping bags that are child-sized may soon out-grow their bags, making it necessary to buy new bags at considerable expense. Many families and other groups own several bags which they would prefer to be interchangeably useable by different members of the family or group, including members having significantly different height, rather than one bag being dedicated for use by only one individual. Unfortunately, many sleeping bag designs incorporate a one-size-fits-all approach that fails to adequately meet the needs of these users.

Therefore, there is a need for a sleeping bag that will fit, to an approximate extent, users of varying height.

SUMMARY OF THE INVENTION

Among the several objects and features of the present invention may be noted the provision of a sleeping bag that is adjustable in length to accommodate users of different height; the provision of such a sleeping bag that provides insulated and portable bedding; the provision of such a sleeping bag that provides for selectively expanding or reducing the length of the bag; and the provision of such a sleeping bag that is easy to use.

In general, an adjustable length sleeping bag of the present invention comprises an elongate insulated shell having a longitudinal axis, an outer surface, a foot end and a head end. A fastening system on the outer surface of the shell comprises one or more first fastener elements disposed around the shell generally transverse with respect to the longitudinal axis, and one or more second fastener elements disposed around the shell generally transverse with respect to the longitudinal axis at a location spaced longitudinally from the one or more first fastener elements. The one or more first fastener elements of the fastening system are selectively engageable with the one or more second fastener elements to reduce the length of the shell to accommodate a person of lesser height, and the one or more first fastener elements are selectively disengageable from the one or more second fastener elements to increase the length of the shell to accommodate a person of greater height.

In another aspect of this invention, the sleeping bag comprises an elongate insulated shell having a longitudinal axis, a foot end and a head end. The shell further has a bottom section, a cover section overlying the bottom section, and a closure panel at the foot end of the shell attached at its periphery to the bottom and cover sections to close the foot end of the shell. A fastening system on the shell comprises one or more first fastener elements disposed around the shell generally transverse with respect to the longitudinal axis, the one or more first fastener elements being located generally adjacent the foot end of the shell, and one or more second fastener elements disposed around the shell generally transverse with respect to the longitudinal axis at a location spaced longitudinally from the one or more first fastener elements and between the one or more first fastener elements and the head end of the shell. The one or more first fastener elements of the fastening system are selectively engageable with the one or more second fastener elements to reduce the length of the shell by collapsing a longitudinal portion of the shell between the one or more first fastener elements and the one or more second fastener elements. The one or more first fastener elements are selectively disengageable from the one or more second fastener elements to allow the collapsed longitudinal portion to be lengthened to increase the length of the shell. The one or more first fastener elements comprise a first row of zipper teeth and the one or more second fastener elements comprise a second row of zipper teeth, the fastening system further comprising a slide fastener for releasably joining the first and second rows of zipper teeth.

Other objects and features of the present invention will be in part apparent and in part pointed out hereinafter.

BRIEF DESCRIPTION OF THE DRAWINGS

Corresponding reference characters indicate corresponding parts throughout the views of the drawings.

DETAILED DESCRIPTION OF THE PREFERRED EMBODIMENT

Figure 1:
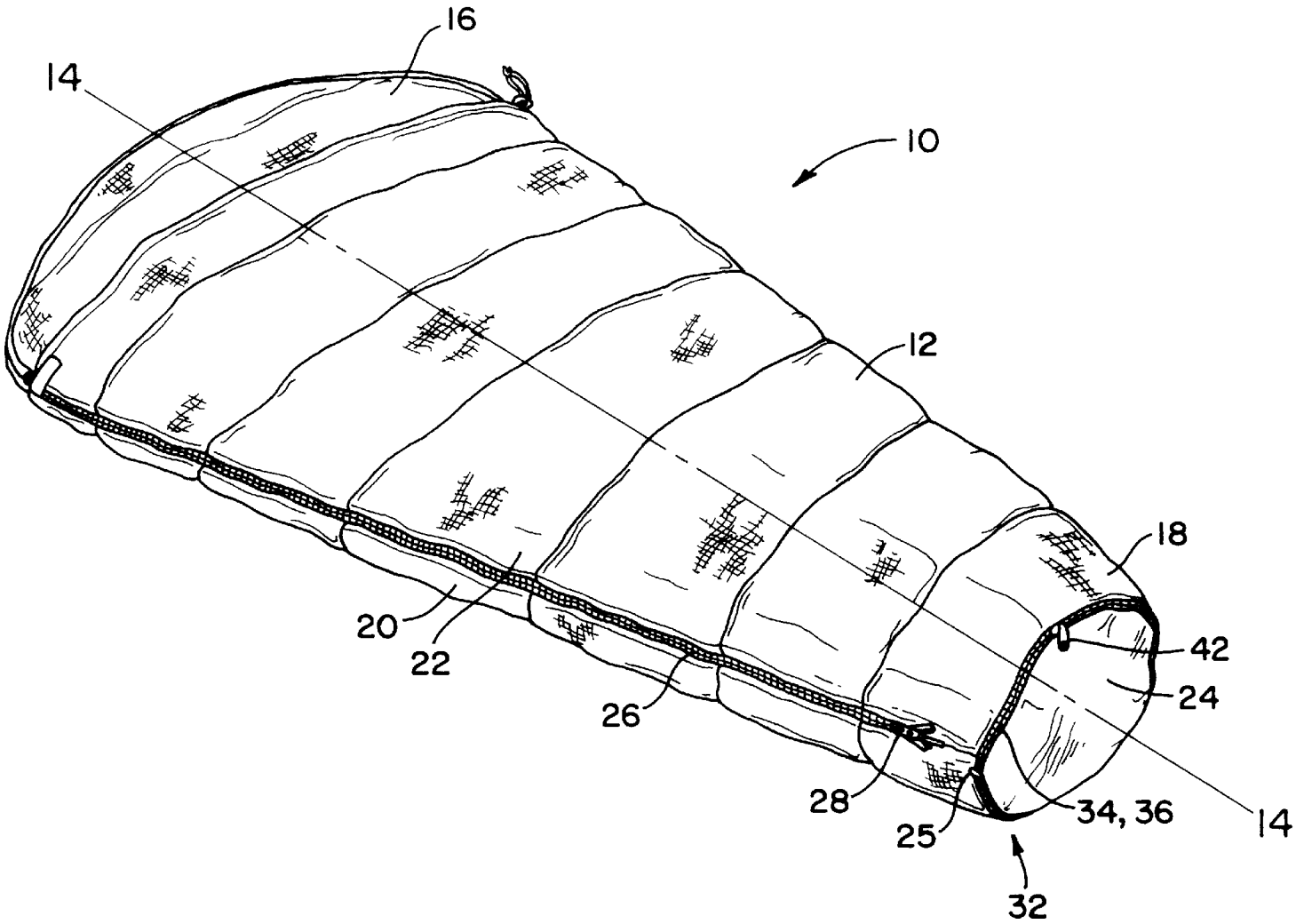
FIG. 1 is a perspective view of an adjustable length sleeping bag of the present invention in a reduced-length configuration.

Referring now to the drawings and in particular to FIG. 1, an adjustable length sleeping bag suitable for use by persons of different height is indicated generally at 10. The bag 10 in FIG. 1 is shown in a reduced-length configuration. Like conventional sleeping bags of the prior art, the sleeping bag 10 of the present invention provides portable and warm bedding.

The sleeping bag 10 comprises an elongate shell 12 with suitable insulation which functions to conserve heat and provide generally soft padding between a person using the bag and an underlying surface on which the user sleeps. The shell 12 has a longitudinal axis 14, a head end 16, and a foot end 18, the head and foot ends corresponding to the positions of the person's head and feet when using the bag. The bag 10 has a bottom section 20 which is intended to underlie the person and a cover section 22 which overlies the bottom section and is intended to cover the person. A closure panel 24 at the foot end 18 is attached at its periphery to the bottom and cover sections 20, 22 to close the foot end. As shown in FIG. 1, the closure panel 24 is generally circular in shape, but it will be understood that other shapes do not depart from the scope of this invention. A loop 25 is preferably attached to the closure panel 24 for hanging the sleeping bag 10 from hooks or the like. A pair of engageable zipper tracks 26 extends along an outer surface of the shell 12 for substantially its entire length at one side of the shell, one track being attached to the bottom section 20 and the other track being attached to the cover section 22. A slide fastener 28 selectively joins the zipper tracks 26 to provide for partial separation of the cover section 22 from the bottom section 20, allowing easy access and egress by the person using the bag.

Figure 2:
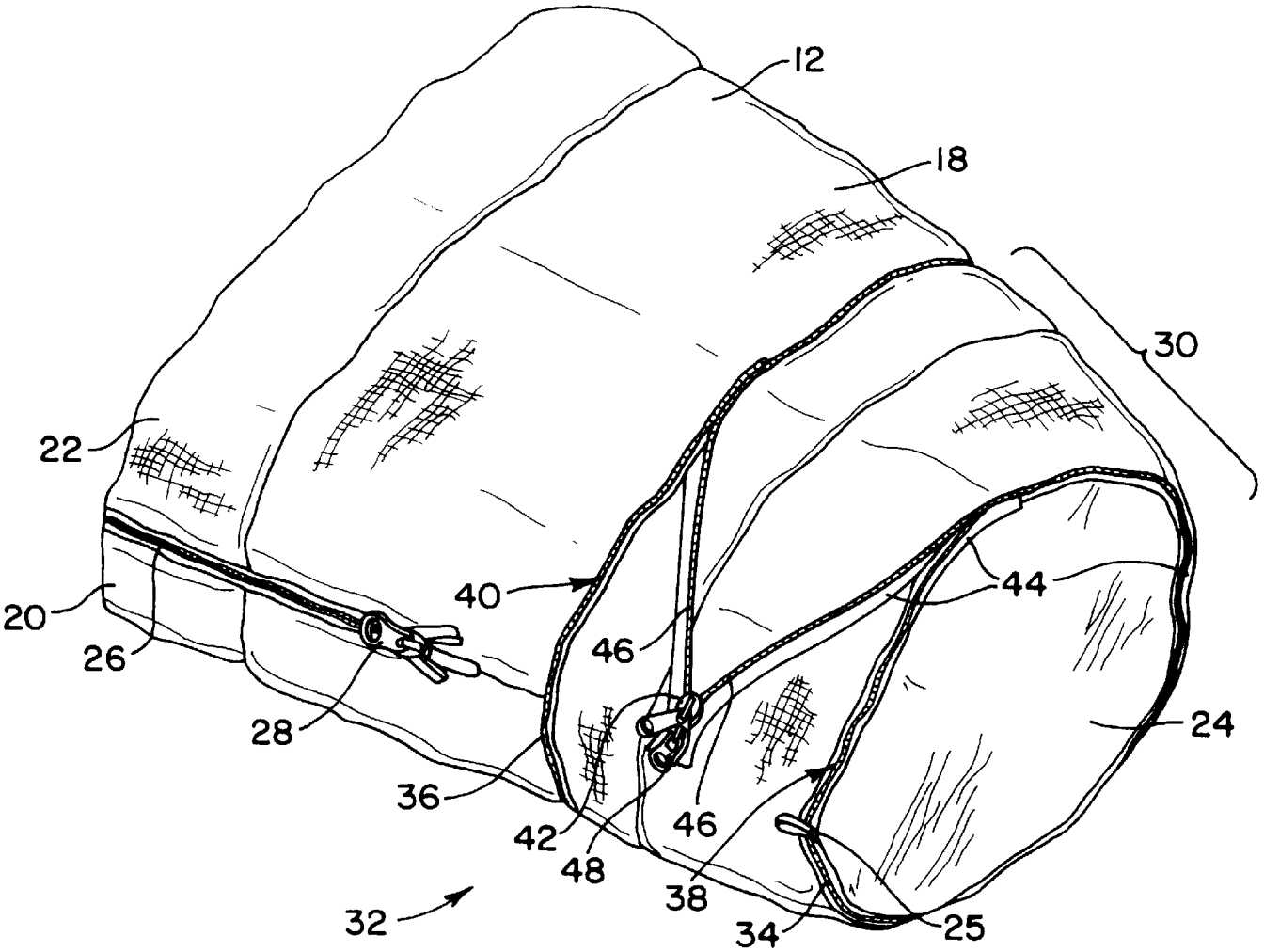
FIG. 2 is a perspective view of a foot end of the sleeping bag in an increased-length configuration.

In accordance with the present invention, the sleeping bag 10 is convertible from the reduced-length configuration shown in FIG. 1 to an increased-length configuration, illustrated in FIG. 2, in which a longitudinal portion 30 of the shell 12 is expanded to increase the length of the bag. The bag 10 can be selectively converted from one configuration to the other by using a fastening system, generally designated 32, on the outer surface of the shell 12.

As shown best in FIG. 2, the fastening system 32 comprises one or more first fastener elements 34 disposed around the shell 12 in an orientation generally transverse with respect to the longitudinal axis 14 of the shell. These fastener elements are located generally adjacent the foot end 18 of the bag 10 near the periphery of the closure panel 24. The fastening system 32 also includes one or more second fastener elements 36 disposed around the shell 12 in an orientation generally transverse with respect to the longitudinal axis 14 of the shell, and spaced longitudinally from the first fastener elements 34. In the preferred embodiment, the first and second fastener elements 34, 36 comprise first and second zipper tracks, generally designated 38 and 40, joined by a slide fastener indicated at 42. Each zipper track comprises a row of zipper teeth attached in a conventional manner to fabric strips 44 of the type provided by zipper manufacturers as components of standard zippers. The fabric strips 44 are suitably attached, as by stitching, to the outer surface of the shell 12 so that the two rows of zipper teeth encircle the entire circumference of the shell at locations spaced apart lengthwise of the shell. The first zipper track 38 and second zipper track 40 are generally parallel in order to provide a symmetric and uniform length bag 10, although parallel rows are not required.

The two zipper tracks 38 and 40 have converging extensions 46 which are attached to the shell 12 and which extend obliquely relative to the longitudinal axis 14 of the bag across the outer surface of the shell. The free ends of the two extensions 46 are connected by the slide fastener 42 which is slidable along the two zipper tracks 38, 40. A second slide fastener 48 may be included if desired for added convenience.

In accordance with this invention the first and second fastener elements 34, 36 are selectively engageable to reduce the length of the shell 12. When the zipper tracks 38 and 40 are joined together, the longitudinal portion 30 of the shell 12 between the two zipper tracks is collapsed to reduce the length of the sleeping bag 10. In the collapsed (reduced-length) configuration, the insulating fabric of the longitudinal portion 30 between the first and second fastener elements 34, 36 bunches together near the closure panel 24, thereby providing a relatively thicker insulation near the foot end 18 than along the other parts of the bag 10.

The length of the bag 10 that is reduced is equal to the longitudinal spacing between the first and second fastener elements 34 and 36. In the preferred embodiment, the length is approximately 10 inches, which provides a variation sufficient to fit adults of significantly different heights. It also provides a reasonable variation in height for a child as he or she grows. However, other longitudinal spacings, either greater or less than 10 inches, do not depart from the scope of this invention.

Figure 3:
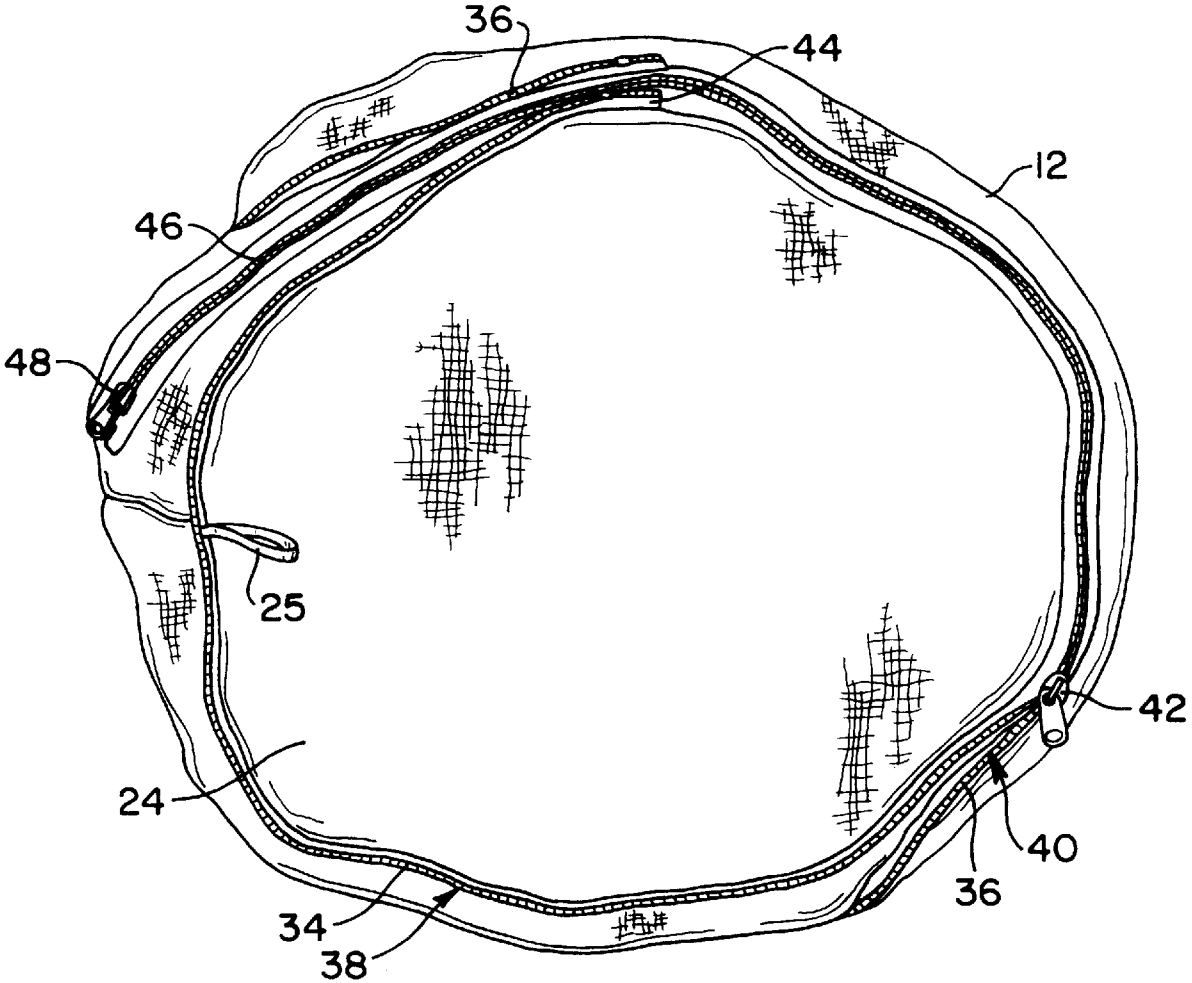
FIG. 3 is an end view of the sleeping bag in an interim configuration between the reduced and increased-length configurations.

In use, the sleeping bag is readily changed between its reduced-length (FIG. 1) and increased-length (FIG. 2) configurations by using the slide fastener 42 to connect or disconnect the two zipper tracks 38 and 40. To shorten the bag from its increased-length configuration, the slide fastener 42 is simply moved from an initial location near a convergence of the two extensions 46. As the slide fastener 42 is moved along the extensions 46, the first zipper track 38 is pulled toward the second zipper track 40, and the longitudinal portion 30 of the shell 12 between the tracks is progressively collapsed. As the slide fastener 42 is moved still further to a point beyond the extensions 46, the first and second zipper tracks 38, 40 are joined together. An end view of the sleeping bag 10 at an interim configuration between the reduced and increased-length configurations is shown in FIG. 3. When the slide fastener 42 is slidably moved around the entire circumference of the shell 12, the first and second zipper tracks 38, 40 are fully joined and the sleeping bag 10 is at the reduced-length configuration seen in FIG. 1.

Although the embodiment shown in FIGS. 1 and 2 shows a fastening system 32 comprising a zipper, other types of first and second fastener elements 34, 36 are also contemplated as falling within the scope of this invention. These include, for example, interengageable hook and loop fasteners (VELCRO), buttons and buttonholes, and snaps and snap-receiving sockets.

The longitudinal portion 30 of the shell 12 that is collapsed need not be at the foot end 18. In other words, the first and second fastener elements 34, 36 can be near the head end 16 of the bag 10 or anywhere along the bag. Further, the sleeping bag 10 may be designed so that multiple longitudinal portions of the shell (rather than just one portion) are collapsible. For instance, the sleeping bag 10 may have many fastener elements disposed around the shell 12 having varying longitudinal spacings from the first fastener elements 34. These fastener elements are selectively engageable with each other or with the first fastener elements, thereby allowing many degrees of length adjustability.

In view of the above, it will be seen that the several objects of the invention are achieved and other advantageous results obtained.

As various changes could be made in the above without departing from the scope of the invention, it is intended that all matter contained in the above description and shown in the accompanying drawings shall be interpreted as illustrative and not in a limiting sense.

What is claimed is:

1. An adjustable length sleeping bag suitable for use by persons of different height, comprising:

an elongate insulated shell having a longitudinal axis, an outer surface, a foot end and a head end; and a fastening system on said outer surface of the shell comprising one or more first fastener elements disposed around the shell generally transverse with respect to said longitudinal axis, and one or more second fastener elements disposed around the shell generally transverse with respect to said longitudinal axis at a location spaced longitudinally from said one or more first fastener elements;

said one or more first fastener elements of said fastening system being selectively engageable with said one or more second fastener elements by collapsing a longitudinal portion of the shell between said one or more first fastener elements and said one or more second fastener elements to reduce the length of the shell to accommodate a person of lesser height, and said one or more first fastener elements being selectively disengageable from said one or more second fastener elements to allow said collapsed longitudinal portion to be lengthened to increase the length of the shell to accommodate a person of greater height.

2. The adjustable length sleeping bag as set forth in claim 1 wherein said one or more first fastener elements are located generally adjacent the foot end of the shell and said one or more second fastener elements are located between said one or more first fastener elements and the head end of the shell.

3. The adjustable length sleeping bag as set forth in claim 1 wherein the length of the shell that is reduced when said one or more first fastener elements are engaged with said one or more second fastener elements is substantially equal to the longitudinal spacing between said one or more first fastener elements and said one or more second fastener elements.

4. The adjustable length sleeping bag as set forth in claim 3 wherein the longitudinal spacing between the one or more first fastener elements and the one or more second fastener elements is about 10 inches.

5. The adjustable length sleeping bag as set forth in claim 1 wherein said one or more first fastener elements comprise a first row of zipper teeth and said one or more second fastener elements comprise a second row of zipper teeth, said fastening system further comprising a slide fastener for releasably joining the first and second rows of zipper teeth.

6. The adjustable length sleeping bag as set forth in claim 5 wherein the first row of zipper teeth has a first extension disposed on the outer surface of the shell that extends at an oblique angle relative to the longitudinal axis generally toward the second row of zipper teeth, and the second row of zipper teeth has a second extension disposed on the outer surface of the shell that extends at an oblique angle relative to the longitudinal axis generally toward the first row of zipper teeth, the first and second extensions converging toward a point located on the outer surface of the shell between the first row and the second row, the first and second extensions being selectively engageable by the slide fastener to join the first and second rows of zipper teeth.

7. The adjustable length sleeping bag as set forth in claim 5 further comprising a second slide fastener for releasably joining the first and second rows of zipper teeth.

8. The adjustable length sleeping bag as set forth in claim 1 wherein said one or more first and second fastener elements are interengageable hook and loop fasteners (VELCRO).

9. The adjustable length sleeping bag as set forth in claim 1 wherein said one or more first and second fastener elements are interengageable buttons and buttonholes.

10. The adjustable length sleeping bag as set forth in claim 1 wherein said one or more first and second fastener elements are interengageable snaps and snap-receiving sockets.

11. The adjustable length sleeping bag as set forth in claim 1 wherein the shell has a bottom section, a cover section overlying the bottom section, and a closure panel at the foot end of the shell attached at its periphery to the bottom and cover sections to close the foot end of the shell.

12. The adjustable length sleeping bag as set forth in claim 11 wherein said one or more first fastener elements extend around the periphery of the closure panel at the foot end of the shell and said one or more second fastener elements are located between said one or more first fastener elements and the head end of the shell.

13. An adjustable length sleeping bag suitable for use by persons of different height, comprising:

an elongate insulated shell having a longitudinal axis, a foot end and a head end, the shell further having a bottom section, a cover section overlying the bottom section, and a closure panel at the foot end of the shell attached at its periphery to the bottom and cover sections to close the foot end of the shell; and a fastening system on the shell comprising one or more first fastener elements disposed around the shell generally transverse with respect to said longitudinal axis, said one or more first fastener elements being located generally adjacent the foot end of the shell, and one or more second fastener elements disposed around the shell generally transverse with respect to said longitudinal axis at a location spaced longitudinally from said one or more first fastener elements and is between said one or more first fastener elements and the head end of the shell;

said one or more first fastener elements of said fastening system being selectively engageable with said one or more second fastener elements to reduce the length of the shell by collapsing a longitudinal portion of the shell between said one or more first fastener elements and said one or more second fastener elements, and said one or more first fastener elements being selectively disengageable from said one or more second fastener elements to allow said collapsed longitudinal portion to be lengthened to increase the length of the shell;

said one or more first fastener elements comprising a first row of zipper teeth and said one or more second fastener elements comprising a second row of zipper teeth, said fastening system further comprising a slide fastener for releasably joining the first and second rows of zipper teeth.

* * * * *